US006875504B2

(12) United States Patent
Malloy et al.

(10) Patent No.: US 6,875,504 B2
(45) Date of Patent: Apr. 5, 2005

(54) BACKING SHEET FOR SURFACE COVERING

(75) Inventors: James M. Malloy, Langhorne, PA (US); F. Joseph Ehrhardt, Haddonfield, NJ (US)

(73) Assignee: Congoleum Corporation, Mercerville, NJ (US)

( * ) Notice: Subject to any disclaimer, the term of this patent is extended or adjusted under 35 U.S.C. 154(b) by 57 days.

(21) Appl. No.: 10/202,033

(22) Filed: Jul. 24, 2002

(65) Prior Publication Data

US 2003/0109622 A1 Jun. 12, 2003

Related U.S. Application Data

(60) Provisional application No. 60/307,631, filed on Jul. 24, 2001.

(51) Int. Cl.[7] ..... B32B 5/16

(52) U.S. Cl. ..... 428/323; 428/329; 428/331; 428/409; 428/542.6

(58) Field of Search ..... 428/323, 329, 428/331, 409, 542.6

(56) References Cited

U.S. PATENT DOCUMENTS

| | | | | |
|---|---|---|---|---|
| 3,293,094 | A | | 12/1966 | Nairn et al. |
| 3,293,108 | A | | 12/1966 | Nairn et al. |
| 3,660,186 | A | | 5/1972 | Sager et al. ..... 156/73 |
| 4,059,709 | A | | 11/1977 | Conger et al. ..... 427/264 |
| 4,071,592 | A | | 1/1978 | Frisch ..... 264/54 |
| 4,126,727 | A | | 11/1978 | Kaminski ..... 428/172 |
| 4,187,131 | A | | 2/1980 | Shortway et al. ..... 156/79 |
| 4,212,691 | A | | 7/1980 | Potosky et al. ..... 156/79 |
| 4,232,076 | A | | 11/1980 | Stetson et al. ..... 428/158 |
| 4,248,922 | A | | 2/1981 | Shortway et al. ..... 428/159 |
| 4,274,916 | A | | 6/1981 | Grose ..... 162/145 |
| 4,277,427 | A | | 7/1981 | Kaminski et al. ..... 264/45.5 |
| 4,278,483 | A | | 7/1981 | Mansolillo ..... 156/79 |
| 4,285,075 | A | * | 8/1981 | Nelson ..... 4/251.1 |
| 4,357,174 | A | * | 11/1982 | Rushbrook et al. ..... 134/10 |
| 4,375,808 | A | | 3/1983 | Graham et al. ..... 126/445 |
| 4,491,616 | A | | 1/1985 | Schmidle et al. ..... 428/158 |
| 4,603,074 | A | * | 7/1986 | Pate et al. ..... 428/172 |
| 5,411,811 | A | | 5/1995 | Piacente et al. ..... 428/542.2 |
| 5,627,231 | A | | 5/1997 | Shalov et al. ..... 524/523 |
| 5,645,889 | A | | 7/1997 | Potosky et al. ..... 427/256 |
| 5,679,443 | A | * | 10/1997 | Barrows et al. ..... 428/206 |
| 5,728,332 | A | | 3/1998 | Frisch et al. ..... 264/46.4 |
| 5,733,630 | A | | 3/1998 | Frisch et al. ..... 428/159 |
| 5,830,937 | A | | 11/1998 | Shalov et al. ..... 524/297 |
| 5,858,160 | A | | 1/1999 | Piacente et al. ..... 156/279 |
| 5,891,294 | A | | 4/1999 | Shih et al. ..... 156/307.7 |
| 5,891,827 | A | * | 4/1999 | Brust et al. ..... 503/227 |
| 5,981,058 | A | | 11/1999 | Shih et al. ..... 428/335 |
| 5,993,534 | A | | 11/1999 | Winterowd et al. ..... 106/461 |
| 6,489,037 | B1 | * | 12/2002 | Winterowd et al. ..... 428/511 |
| 6,579,610 | B1 | * | 6/2003 | Shortland et al. ..... 428/323 |
| 6,617,008 | B1 | * | 9/2003 | Kono et al. ..... 428/201 |
| 6,680,087 | B2 | * | 1/2004 | Park et al. ..... 427/508 |
| 6,699,567 | B2 | * | 3/2004 | Mullen et al. ..... 428/172 |

* cited by examiner

*Primary Examiner*—H. Thi Le
(74) *Attorney, Agent, or Firm*—Synnestvedt & Lechner LLP

(57) ABSTRACT

A stain-adsorbing backing sheet for use with a decorative surface covering; a decorative surface covering comprising a stain-adsorbing backing sheet; and a method for forming a stain-adsorbing backing sheet for a decorative surface covering. The backing sheet comprises an additive which is effective in adsorbing a stainant that comes into contact with the backing sheet and which is present in an amount effective to reduce the degree of staining which tends to be visible in the top surface of the covering. The additive is preferably an adsorbing material that does not affect adversely the visual characteristics of the sheet and surface covering.

14 Claims, 4 Drawing Sheets

Weight % Activated Charcoal in Felt

BACKING SHEET FOR SURFACE COVERING

CROSS-REFERENCE TO RELATED APPLICATIONS

This application is based on and claims priority to U.S. Provisional Application No. 60/307,631, filed Jul. 24, 2001.

FIELD OF THE INVENTION

The present invention relates generally to a decorative surface covering for floors, walls, and the like. In particular, this invention relates to a surface covering which resists staining.

A surface covering typically comprises a composite of one or more resinous composition layers, including, for example, a decorative layer and/or wear layer, together formed on a backing sheet. The backing sheet generally comprises a relatively flat web or sheet material, that is, a material which functions as a support or carrier for the overlying resinous composition layer(s). Such backing sheet can comprise, for example, a felt material, a polymeric material, or a fiber-reinforced material, including, for example, fibers of glass and natural and synthetic fibers. The backing sheet can be a permanent ply of the final product or it can be separated from the overlying resinous composition layer; in the latter case, release paper is used as the backing sheet. For purposes of the present invention, the backing sheet is considered to be a permanent ply of the surface covering.

It has been observed that problems are encountered with respect to staining of the resinous composition layer of the decorative surface covering. In particular, stains visible on the surface of the covering are observed when staining chemicals, known in the industry as "stainants," for example, dyes and the like, diffuse through the surface covering from an underlying support surface on which the surface covering is placed. A widely used surface covering which is subject to the staining problem is a floor covering such as vinyl floor covering. In particular, stainants commonly diffuse from an underlying surface, for example, a wooden floor or floor mat which is in contact with the backing sheet of the floor covering, through the various layers of the floor covering where staining becomes undesirably visible to the eye of the consumer. The source of the stainant may be, for example, dyes, ink from pens or markers, coatings on nails or other hardware, adhesives used to bond the flooring to the substrate, or oils or extractives in the substrate itself, for example, from wood or wood-based substrates.

It is common practice in the flooring industry to install wood-based underlayment panels on top of a structural subfloor and just beneath decorative vinyl floor covering. The primary purpose of the panels is to provide a stable substrate of uniform thickness to which the floor covering is attached. Current commonly used materials for underlayment panels include strand board, particle board, and plywood. Generally, after the wood-based underlayment panels are installed, the vinyl floor covering is bonded adhesively or otherwise attached to the exposed surface of the panels. Various suitable adhesive materials, for example, fill-spread adhesive and perimeter adhesives, are used to attach the vinyl floor covering to the surface of the panels. Other vinyl floor covering attachment means include mechanical fasteners such as staples.

It has been observed that there is a tendency for stains to develop on the upper surface of the vinyl floor covering within approximately 3 to 24 months after attachment to the underlayment panels. Although the specific process of stain formation is not understood definitively, it is believed that, over such a period of time, certain stainants, emanating from the wood or otherwise, diffuse into the vinyl floor covering and migrate through to the surface of the covering and manifest themselves as "stains."

REPORTED DEVELOPMENTS

Attempts have been made to resolve the problem of staining, in particular, the prevention of the migration of stainants. Some researchers have observed that staining can be prevented or "blocked" by placing a sheet of aluminum foil between the wood underlayment panels and the vinyl floor covering. Presumably the stainants are insoluble in aluminum and, thus, are unable to migrate into the vinyl floor covering.

Unfortunately, the aluminum foil is not stable or durable, as it is torn or punctured readily and, therefore, not reliable as a cohesive barrier to the stainants. Also, various conventional adhesives used to secure the vinyl floor covering to the wood surface may not be compatible with the aluminum; and, further, aluminum foil is relatively expensive. It has been recognized also that various commercially available patching compounds which contain high levels of Portland cement may be used as stain-blocking barriers. The patching compound is applied to the top surface of the underlayment panels at the site of installation and allowed to set prior to installing the vinyl floor covering; however, such a method is relatively inconvenient and burdensome.

Other attempts to overcome the problem of staining are likewise deficient. U.S. Pat. Nos. 5,891,294 and 5,981,058 disclose the use of a stain-blocking, barrier layer. The barrier layer is intended to be placed between the underlying support surface, for example, underlayment panels, and a layer of the surface covering. The barrier layer is comprised of at least one polyamide or polyurethane which has selective properties which are designed to prevent stain diffusion. It is recognized in the patents that there is a difficulty incurred in adhering the polyamide to the surface of vinyl floor covering, in which case a coating of adhesion promoter must be applied to both the top and bottom surfaces of the barrier layer. The application of such additional coatings may require additional curing time which would make for an inefficient operation.

U.S. Pat. No. 5,993,534 discloses another attempt to manage the diffusion of stainants, in particular, the use of a stain-blocking coating for use on the underlayment panels themselves. The patent discloses the pretreatment of wood-based underlayment panels at the manufacturing site of the panels. This involves pretreating the top surface of the panels with a liquid coating composition comprising an anti-staining agent, for example, an alkaline, inorganic, multivalent compound such as magnesium hydroxide. The composition may also include a binding agent for purpose of securing all of the solid, suspended particles in the coating composition to the wood substrate. In addition to magnesium hydroxide, sodium borate and magnesium oxide are taught to be suitable anti-staining agents; however, such compositions have a shorter shelf-life than those based on magnesium hydroxide and, therefore, require the disadvantage of on-site mixing at the manufacturing site.

From the foregoing it can be seen that prior art efforts to prevent staining of the resinous composition layer of decorative surface coverings involve the application of stain-blocking, barrier coatings or barrier layers between the support surface and the surface covering product. The present invention is directed to an alternative approach which does not require a distinct structural element such as a stain-blocking barrier coating or layer.

SUMMARY OF THE INVENTION

In accordance with the present invention, a surface covering is provided with a stain-adsorbing backing sheet. The backing sheet comprises an additive which is effective in adsorbing a stainant that comes into contact with the backing sheet and which is present in an amount effective to reduce the degree of staining which tends to be visible upon viewing the top surface of the covering. The additive may be any adsorbing material, and preferably an adsorbing material that does not affect adversely the visual characteristics of the sheet and surface covering. A particularly preferred additive is activated charcoal.

It has been found that the presence in the backing sheet of a stain-adsorbing additive is effective for retaining in the backing sheet a stainant which comes into contact therewith. This deters the migration or diffusion of the stainant through to the visible top surface of the surface covering which overlies the backing sheet.

Another aspect of the present invention is the provision of a process for forming a backing sheet for a surface covering in which the sheet is formed from an aqueous dispersion of solids and an additive which is effective for adsorbing a stainant which may come into contact with the sheet.

There are a number of advantages provided by the present invention. One important advantage is that the manufacturer can produce on a continuous basis a stain-resistant surface covering in a way which utilizes available equipment and known processing conditions which have become standard in the industry. In addition, species of the adsorbent additive of the present invention are available readily and of relatively low cost to the manufacturer.

It is noted that U.S. Pat. No. 5,679,443, assigned to the same assignee as the present invention, discloses the formation of a backing sheet which includes carbon black, a material that has adsorbent properties. However, it has been observed that, although carbon black is an effective adsorbent, there is a disadvantage associated with its use. The disadvantage is that the use of carbon black in effective "adsorbent" amounts in a backing sheet directly affects the color of the backing sheet and, consequently, the color and appearance of the surface covering. Accordingly, another significant advantage of the adsorbents of the present invention is that they can be used effectively in an amount which does not influence or impair adversely the visual characteristics of the backing sheet.

DETAILED DESCRIPTION

Figure 1:
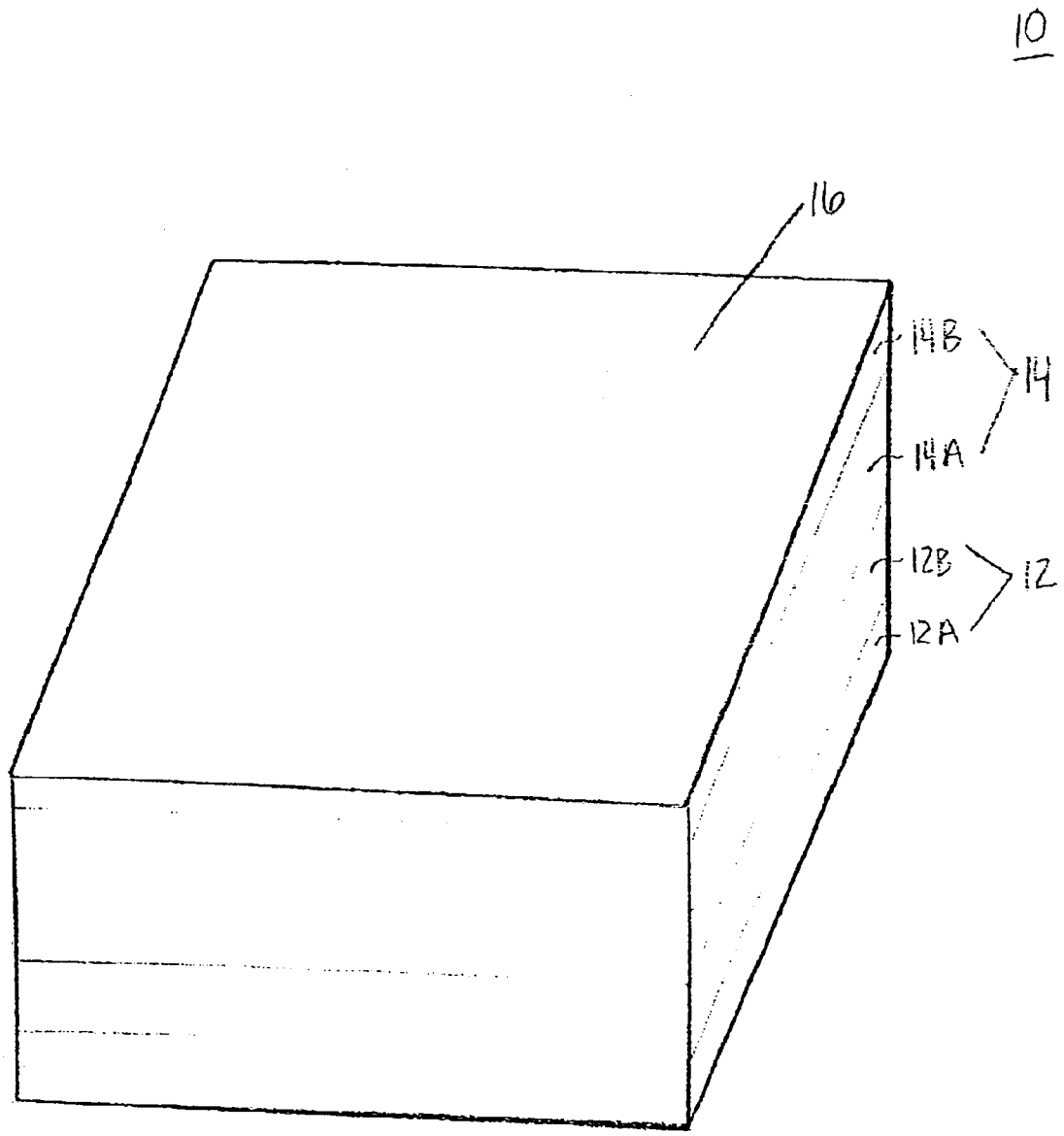
FIG. 1 is an enlarged cross-sectional illustration of the basic structure of a surface covering which includes a backing sheet in accordance with the present invention.

The present invention relates to a stain-adsorbing backing sheet for use with a decorative surface covering, to a decorative surface covering comprising a stain-adsorbing backing sheet, and to a method for forming a stain-adsorbing backing sheet. Referring to FIG. 1, the surface covering 10 comprises generally a base layer 12 and an overlying layer 14. As is well known in the art, layer 14 may include one or more resinous layers 14A, including one or more printed layers, which are typically decorative in nature, and a top coat or wear layer 14B which is typically transparent to provide visual access to the underlying decorative layer. As also known in the art, the base layer 12 includes at least a relatively flat backing sheet material 12A and may further include an intermediate resinous layer 12B which functions to provide a cushion layer to the covering.

The Overlying Decorative Layer

The present invention includes an overlying decorative layer 14 that may comprise, for example, one or more printed and/or embossed or foamed 14A and/or one or more wear layers 14B. Many types of decorative layers are known and are described, for example, in U.S. Pat. Nos. 3,293,094; 4,212,691; 4,277,427; 5,645,889; and 5,733,630. It should be understood that the present invention is applicable to any surface covering having any type of overlying decorative layer 14 which is subject to becoming stained from its underside, that is, the overlying decorative layer 14 is understood to be of a composition such that a stainant is capable of migrating upwardly therethrough to produce a stain which is visible to the naked eye as one views the top surface 16 of the surface covering, for example, a surface covering having a transparent wear layer 14B.

An example of a widely used decorative layer 14 comprises a fused plastisol. As is known to those skilled in the art, a plastisol in the unfused state comprises solid thermoplastic resin particles dispersed in a liquid plasticizer. The application of heat to the liquid plastisol causes the gellation and eventual fusion of the plasticizer and resin particles. Although a number of resins are known in the art for use in plastisols, it is generally preferred that the resin comprise particles which are combined readily with the plasticizer to form a smooth, stable, flowable paste. Preferred resins include vinyl polymers and, more preferably, vinyl chloride polymers, for example, poly(vinyl chloride).

The plasticizer generally functions to increase the workability, flexibility and/or distensibility of the resin with which it is associated. The plasticizer is commonly selected on the basis of its compatibility with the resin, that is, its ability to form a gel, and ultimately a fused solid, when the composition is heated. As is well known, plasticizers are generally high-boiling, chemically and thermally stable organic liquids, low-melting solids or semi-solids. Those skilled in the art are capable of selecting the appropriate plasticizer for any particular application. Widely used plasticizers include ester compounds such as monomeric phthalate esters, dibasic acid esters, trimellitates, phosphate esters and polyesters.

The Backing Sheet

The backing sheet 12A functions as a carrier and support for the overlying decorative layer 14. It may be made of any suitable material. The nature of the material is such that it is capable of being penetrated by a stainant which comes into contact with the normally exposed surface of the backing sheet. The stainant may be present, for example, in an adhesive which is sandwiched between the surface of the backing sheet and wood-based underlayment panels or in a wooden substrate on which the surface covering is laid.

Backing sheets are described, for example, in U.S. Pat. Nos. 5,679,443; 3,293,094; 3,293,108; 3,660,186; and 4,274,916, each of which is assigned to the assignee of the present invention. Materials from which the backing sheet can be made include natural and synthetic materials, for example, cellulose, cotton, jute, wool, rayon, nylon, polyester, polyolefin, polyamide, acrylic, glass, and metallic threads.

The backing sheet may be made, for example, of a felted or matted fibrous material of overlapping, intermingled fibers and/or filaments. Further, the backing sheet may be in a non-woven, knitted, woven or other form. In addition, the backing sheet may be made from a resinous material or from paper or from mineral filled fibrous compositions. Furthermore, the backing sheet may comprise a laminate or composite of one or more of the above-noted materials. It is preferred that the backing sheet be made of felt.

The thickness of the backing sheet depends upon various factors, including, for example, the particular surface covering in which it is used and the particular use of the surface covering. Normally, the thickness of the backing sheet will be in the range of from about 10 mils to about 90 mils, although thicknesses outside of this range can be used.

Backing sheets which are used widely in floor coverings are formed typically from a slurry of fibrous material and water using any of the techniques conventionally employed in the manufacture of paper. For example, sheet formation can take place on a Fourdrinier or cylinder machine or any other type of web-forming machine. The fiber slurry is diluted with water until it has a preferred consistency or percent solids concentration. It is then pumped to the web-forming machine and formed into a sheet material of the desired thickness and weight. The bulk of the slurrying water drains downwardly from the mass of fibrous materials through a moving screen of the web-forming machine and, subsequently, additional water is removed by a conventional press section by being passed under pressure through conventional felts or pressure rolls. The moist sheet is then passed through a conventional drier section where it passes in contact over a number of conventionally heated dryer rolls or cans. A substantially dry sheet leaves the last drying can and is formed normally into a roll or sheeted into size or held for further use or processing. The fibers of choice for the backing sheet of the surface covering of the present invention include cellulose, fiberglass, polyester and/or polyamide.

The backing sheet 12A may be covered with an optional layer 12B, for example, one or more layers comprising foamed or non-foamed resin. Such resin layers are well known and comprise one or more synthetic resins, for example, a polymer or co-polymer or vinyl chloride or a polyurethane. Resin layer 12B will typically have a thickness of from about 10 to about 80 mils.

The Additive

In accordance with the present invention, the backing sheet 12A includes an additive which is effective in adsorbing a stainant in a manner such that staining of the overlying decorative layer 14 of the surface covering is reduced or avoided. The term "stainant" refers to any material which itself or in combination with one or more other materials is responsible directly or indirectly for causing a stain which is visible to the naked eye as one views the top surface 16 of the overlying decorative layer 14 of the surface covering. The term "adsorbing" is used in its normal sense and also broadly to mean that some or all of the stainant is retained in some manner in the backing sheet and prevented from diffusing into the overlying decorative layer. The term "adsorbent" is likewise used in its normal sense to refer to any material which effects the attraction and adherence of stainant molecules to the surface of its own molecules and also broadly to refer to any material that is capable of adsorbing.

A stainant is believed to emanate from various materials which underlie surface coverings. The underlying material is in contact with the backing sheet. The stainant penetrates the surface of the backing sheet in contact therewith and moves upwardly through the layer(s) of the surface covering to a visible top surface 16 thereof.

One example of a stainant is a chemical contained in elm wood, namely, 7-hydroxy cadalenal or 7HC. Elm wood is found commonly in wood substrates, for example, as a component of oriented strand board (OSB), for surface coverings such as vinyl flooring. The 7HC diffuses through the backing sheet and overlying layer(s) of the surface covering, migrating to a visible surface of the decorative layer and producing an undeniable yellow color or stain which is visible to the naked eye.

The additive that is used in the backing sheet in accordance with the present invention may depend, at least in part, on the nature of the stainant. The additive can be any material that is capable of adsorbing or otherwise retaining the stainant in the backing sheet. The additive is preferably a material that does not affect adversely the visual characteristics of the backing sheet, that is, the appearance of the sheet, for example, the color thereof. Examples of effective adsorbents that can be used are activated charcoal, activated alumina, and fumed silica.

A particularly preferred adsorbent additive is activated charcoal. Activated charcoal is amorphous in nature and has a relatively large surface area. In addition to being an excellent adsorbent, activated charcoal does not affect adversely the visual characteristics, for example, the color of the backing sheet.

The amount of additive present in the backing sheet will depend on various factors, including, for example, the nature of the anticipated stainant, the additive that is used, the thickness of the backing sheet, the proportion of ingredients comprising the sheet and the specific nature of the components comprising the surface covering. It is believed that an amount of additive in the range of about 0.001 to about 5 wt. % based on the total weight of the ingredients comprising the backing sheet will be effective in mitigating or avoiding the staining problem. Adjustments in amounts can be made as needed for the particular application. It is believed that for most applications an amount of additive of about 0.005 to about 0.1 wt. % will be satisfactory.

Although it is expected that the present invention will be used most widely in the manufacture of multi-layered sheeting which is designed especially for use as decorative floor coverings, it should be understood that the invention can be used also to manufacture other types of multi-layered surface coverings which can be used in a variety of applications such as, for example, wall and ceiling coverings and table, desk, and counter-top surface coverings.

EXAMPLES

The following examples are illustrative of the present invention. Comparative examples are set forth below also.

Materials utilized in the examples include: 7-hydroxy cadalenal (7HC), which is a stainant that has been found in some types of oriented strand board (OSB) and which was extracted from elm wood using tetrahydrofuran and re-dispersed quantitatively in hexane; and felt backing sheet material of the standard Congoleum production and formulation that is the subject of U.S. Pat. No. 5,679,443.

The first group of examples demonstrates the relative capability of activated charcoal, activated alumina, and fumed silica to adsorb stainant. A comparative example includes a control sample.

Figure 2:
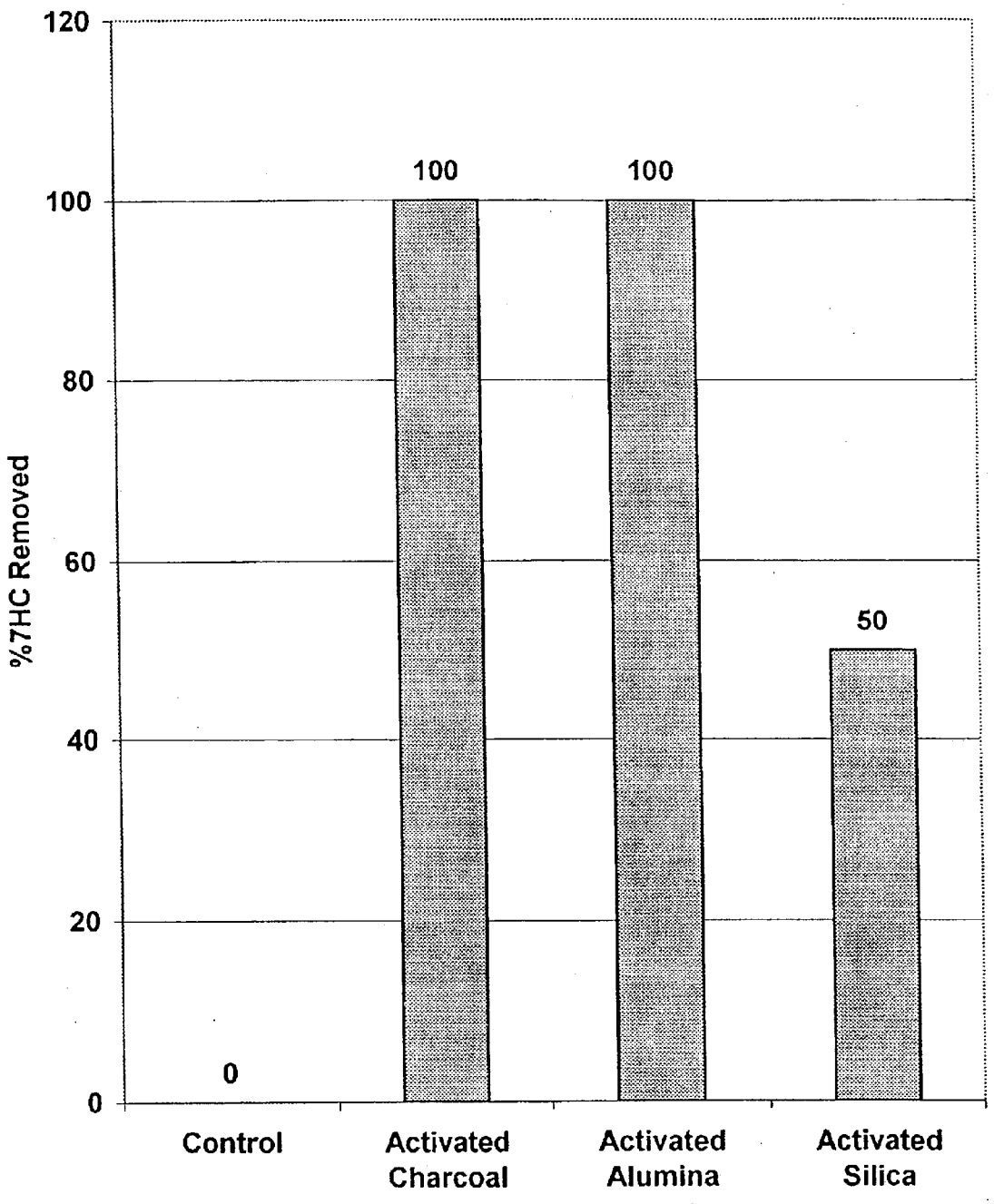
FIG. 2 illustrates the relative adsorbent effectiveness of various adsorbent materials.

7HC was extracted from elm and dissolved in hexane; the approximate concentration was about 0.1 mg 7HC/ml of hexane. In three vials, about 15 mg of the following adsorbents were placed: activated charcoal; activated alumina; and fumed silica. A fourth vial functioned as the control, containing no adsorbent material. Two ml of the 7HC solution were added to each vial and allowed to sit for 16 hours. Each solution was then filtered and analyzed for 7HC using gas chromatography. The results are presented in FIG. 2 and in the Table 1 below.

TABLE 1

| Ex. No. | Sample | 7HC Conc. Remaining in Solution, mg/ml | % 7HC Removed |
|---|---|---|---|
| 1-C | Control | 0.102 | 0 |
| 1 | Activated Charcoal | not detected | 100 |
| 2 | Activated Alumina | not detected | 100 |
| 3 | Fumed Silica | 0.054 | 50 |

The superior adsorbing effects of activated charcoal and activated alumina are evident from the test results reported in Table 1 above.

The next group of examples involves the use of adsorbents of the present invention in tests that were designed to determine the quantity of stainant that is retained in the felt portion of a flooring sample, relative to the quantity that migrates to wear layer of the sample. The proportion of adsorbent additive comprising the solids content of the aqueous dispersion used to make a backing sheet are believed to correspond substantially to the proportion of adsorbent additive comprising the resulting sheet.

A small circle (0.75 cm diameter) of sample was cut from a flooring product and placed in the cap of a standard glass 4 ml septum vial typically used for gas chromatography work. The flooring product comprised a wear layer comprisingpoly(vinyl chloride) and plasticizer, a poly(vinyl chloride) foamed layer, and a standard formulation felt layer. The sample replaced the septum typically used with these vials. The sample was placed with the felt facing the bottom of the vial. A small quantity of 7HC (about 0.05 mg) was added to the bottom of the vial. The cap was placed tightly on the vial and the vial was placed in a 158° F. oven for typically two days. During this time, the flooring was exposed to 7HC vapor. Because not all of the 7HC evaporates under these conditions, the exposure level (equal to the vapor pressure of 7HC at 158° F.) was the same for multiple experiments.

After the allotted time in the oven, the sample was removed from the oven and separated into wear layer, foam, and felt layers. The concentration of 7HC was then measured in each layer using standard analytical extraction techniques and gas chromatography. The results were normalized to a percentage basis to determine the proportion of 7HC that was present in each layer. The effectiveness of the stain adsorbent is demonstrated by the amount of stainant retained in the felt layer.

Example No. 4

Figure 3:
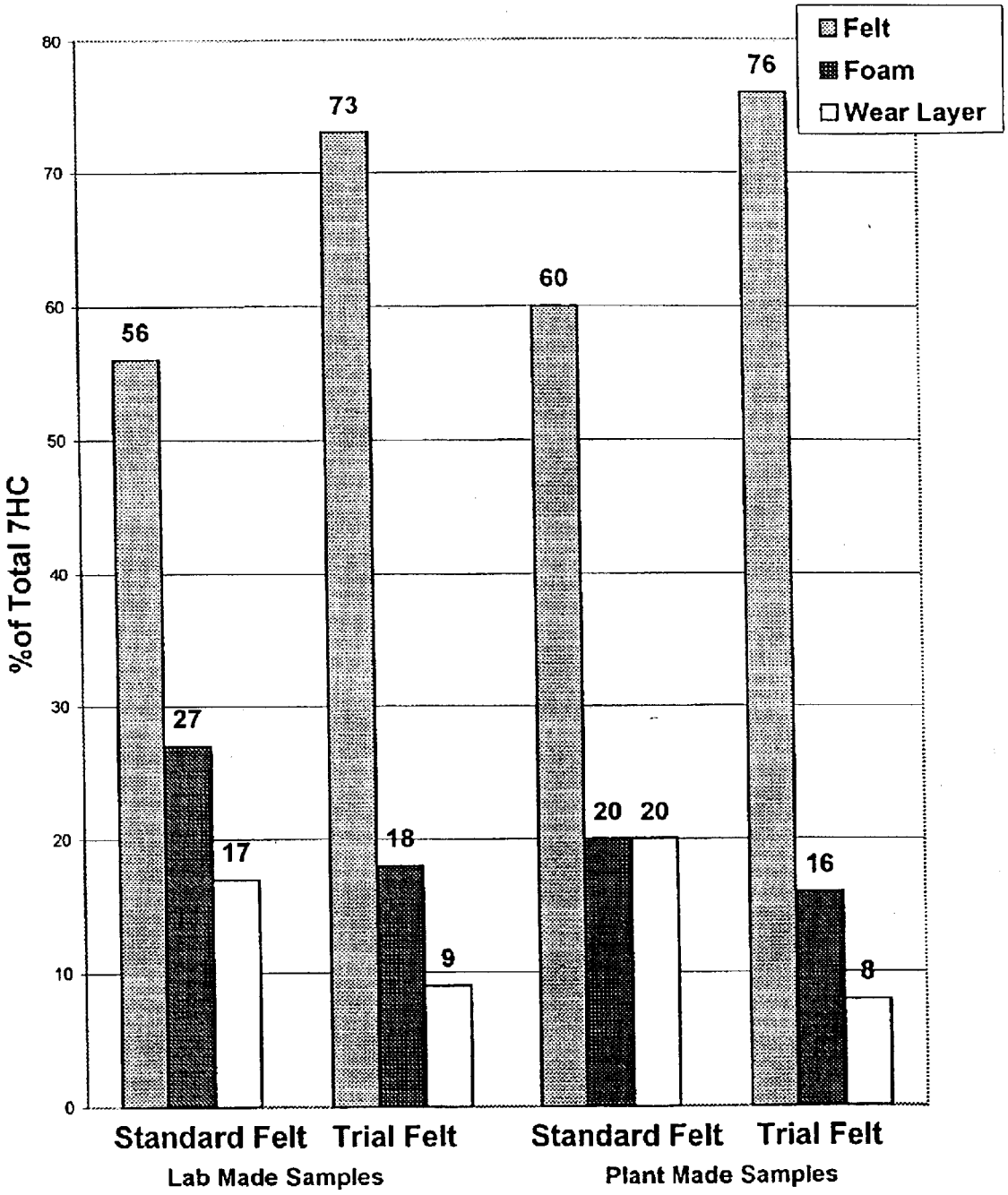
FIG. 3 illustrates the adsorption (percentage retention) of the stainant 7-hydroxy cadalenal in the felt, foam and wear layers of samples of floor coverings in which felt backing sheets contain activated charcoal.

Standard felt was produced using standard production and formulation procedures and trial felt was made using the same production and formulation procedures, except that activated charcoal was added at about a 0.0188 weight % addition rate. Some samples of the standard and trial felts were further incorporated into vinyl flooring products that were made in the laboratory using standard flooring formulations. Additional samples of the standard and trial felts were incorporated into vinyl flooring products that were made at a production plant. Samples of each of the products were exposed to 7HC vapor for a period of two days at 158° F. for the laboratory-made products and for a period of three days at 158° F. for the plant-produced products. After this time, the layers of the products were separated and analyzed for concentration of 7HC. Each exposure experiment was completed in duplicate. The results are presented in FIG. 3 and in Table 2 below.

TABLE 2

| | Products of Laboratory | | Products of Plant Production | |
|---|---|---|---|---|
| | Standard Felt | Trial Felt | Standard Felt | Trial Felt |
| % 7HC in Felt Layer | 56 | 73 | 60 | 76 |
| % 7HC in Foam Layer | 27 | 18 | 20 | 16 |
| % 7HC in Wear Layer | 17 | 9 | 20 | 8 |

The results set forth in Table 2 above demonstrate that activated charcoal is an effective adsorbent for 7HC. In particular, activated charcoal is effective in retaining 7HC in the felt layer and thereby reducing by about half the amount of 7HC which would otherwise be capable of migrating up through the product to the wear layer.

Example Nos. 5–8

Figure 4:
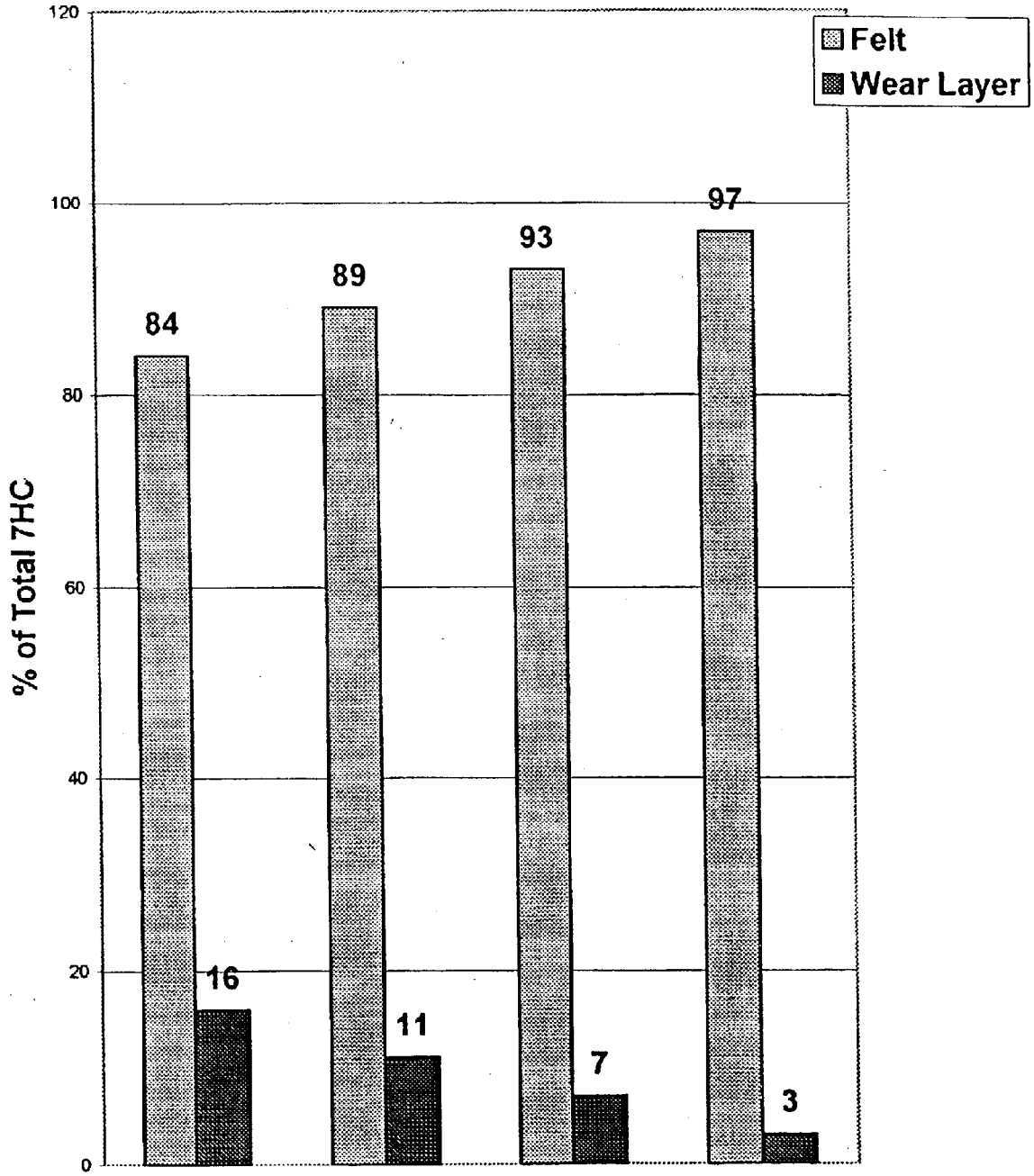
FIG. 4 illustrates the adsorption (percentage retention) of the stainant 7-hydroxy cadalenal in a felt backing sheet and the resulting impact on wear layer staining of samples of floor coverings in which the felt backing sheets contain various amounts of activated charcoal.

A backing sheet was prepared using standard felt formulation procedures, except activated charcoal was included in samples of the backing sheet in varying, increasing amounts. The samples were then coated with a standard wear layer formulation comprising poly(vinyl chloride) and plasticizer. A foam layer was not present in these samples. The samples were exposed to 7HC vapor for a period of two days at 158° F. The results are shown in FIG. 4 and in Table 3 below.

TABLE 3

| | Weight % | % 7HC | |
|---|---|---|---|
| Example No. | Activated Charcoal | Felt Layer | Wear Layer |
| 5 | 0.010 | 84 | 16 |
| 6 | 0.020 | 89 | 11 |
| 7 | 0.1 | 93 | 7 |
| 8 | 0.5 | 97 | 3 |

The results of the above examples demonstrate that increasing amounts of adsorbent further limits the amount of stainant that migrates from the felt to the wear layer; and that, as activated charcoal is added in increasing quantities, the amount of stainant reaching the wear layer approaches zero.

Example 2-C

As mentioned above, the use of carbon black in backing sheets is disclosed in U.S. Pat. No. 5,679,443 in amounts of about 0.0001 to about 0.05 weight %. And tests have shown that carbon black does function as an adsorbent for 7HC, as can be seen from the present Example.

Felt was produced using standard production and formulation procedures, except that varying amounts of carbon black were added prior to forming the felt sheet. The felt samples were each further incorporated into vinyl flooring products that were made at a production plant. Samples of each of the products were exposed to 7HC vapor for a period of two days at 158° F. After this time, the layers of the products were separated and analyzed for concentration of 7HC. Each exposure experiment was completed in duplicate. The results are presented in Table 4 below.

TABLE 4

| | Weight % Carbon Black | | | |
|---|---|---|---|---|
| | .005 | .010 | .014 | .019 |
| % 7HC in Felt Layer | 56 | 64 | 67 | 71 |
| % 7HC in Foam Layer | 25 | 19 | 20 | 23 |
| % 7HC in Wear Layer | 19 | 17 | 13 | 6 |

The above test results demonstrate that carbon black is an effective adsorbent for 7HC. However, in amounts that are effective for adsorbing the 7HC stainant, it has been observed that the visual characteristics of the resulting sheet are affected in a way such that the sheet appears darker in color and appearance. Such a result is undesirable because the color of the backing sheet influences the color of the resulting surface covering product; in particular, if the backing sheet becomes darkened in color, the appearance of the product is likewise darkened.

What is claimed is:

1. A backing sheet for use with a decorative surface covering capable of becoming stained and comprising an additive effective for adsorbing a stainant in said backing sheet and which additive does not affect the visual characteristics of the sheet.

2. A backing sheet according to claim 1 wherein the sheet comprises about 0.001 to about 5 wt. % of said additive.

3. A backing sheet according to claim 1 wherein the sheet comprises about 0.005 to about 0.1 wt. % of said additive.

4. A backing sheet according to claim 1 wherein said additive does not affect the color characteristics of the sheet.

5. A backing sheet according to claim 1 wherein said additive comprises activated charcoal.

6. A backing sheet according to claim 1 wherein said additive comprises activated alumina.

7. A backing sheet according to claim 1 wherein said additive comprises fumed silica.

8. A backing sheet for use with a decorative surface covering capable of becoming stained, said backing sheet comprising as an additive 0.001 to about 5 wt. % activated charcoal.

9. In a backing sheet for a decorative surface covering capable of becoming stained, the improvement comprising the presence in the sheet of a sufficient amount of an additive which is effective for substantially retaining in the sheet a stainant and which does not affect the visual characteristics of the sheet.

10. A decorative surface covering comprising an overlying decorative layer capable of becoming stained and an underlying backing sheet which includes an additive which is effective in adsorbing a stainant which comes into contact with said backing sheet and which additive does not affect the visual characteristics of the sheet.

11. A backing sheet for use with a decorative surface covering capable of becoming stained and comprising one or more of activated charcoal, activated alumina and fumed silica.

12. A poly(vinyl chloride)-based floor covering comprising the backing sheet of claim 11.

13. In a process for forming a backing sheet for a surface covering, in which the sheet is formed from an aqueous dispersion of solids, the improvement comprising adding to the aqueous dispersion an additive which is effective in adsorbing a stainant which comes into contact with the sheet and which additive does not affect the visual characteristics of the sheet.

14. A method for forming a stain-adsorbing backing sheet for a decorative surface covering comprising preparing an aqueous dispersion of solids and including in said dispersion an additive which does not affect the visual characteristics of the sheet and which is present in an amount sufficient to adsorb a stainant which comes into contact with said sheet.

* * * * *